US010852107B1

(12) United States Patent
Wu

(10) Patent No.: US 10,852,107 B1
(45) Date of Patent: Dec. 1, 2020

(54) CASELESS PROJECTILE

(71) Applicant: Ting-Hua Wu, Miaoli (TW)

(72) Inventor: Ting-Hua Wu, Miaoli (TW)

( * ) Notice: Subject to any disclaimer, the term of this patent is extended or adjusted under 35 U.S.C. 154(b) by 0 days.

(21) Appl. No.: 16/884,368

(22) Filed: May 27, 2020

(30) Foreign Application Priority Data

May 5, 2020 (TW) ..... 109114923 A

(51) Int. Cl.
*F42B 5/18* (2006.01)

(52) U.S. Cl.
CPC ..... *F42B 5/18* (2013.01)

(58) Field of Classification Search
CPC .. F42B 5/18; F42B 5/181; F42B 5/182; F42B 5/192
USPC ..... 102/431–433, 469
See application file for complete search history.

(56) References Cited

U.S. PATENT DOCUMENTS 694,295 A * 2/1902 Maxim ..... C06B 45/00 102/288
3,486,451 A * 12/1969 Moore ..... F42B 5/10 102/517
3,688,697 A * 9/1972 Paul ..... F42B 5/18 102/431
3,718,089 A * 2/1973 Weise ..... F42B 5/184 102/433
2007/0144393 A1* 6/2007 Kusz ..... F42B 5/18 102/374

* cited by examiner

*Primary Examiner* — Reginald S Tillman, Jr.
(74) *Attorney, Agent, or Firm* — Locke Lord LLP; Tim Tingkang Xia, Esq.

(57) ABSTRACT

Disclosed herein is a caseless projectile, in which a bullet head and a projectile body structure are fixedly arranged with each other. The caseless projectile can be fired in a barrel without a step of discharging the case; further, the caseless projectile's projectile bottom has a plurality of blade-shaped score lines. When fired, the score line are transformed into a plurality of nozzle structures by the impact force, so that the high-pressure gas generated by the burning of powder is ejected through the nozzle structures, further offering the caseless projectile a rotational torque and achieving the effect of accurate firing without rifling.

16 Claims, 6 Drawing Sheets

CASELESS PROJECTILE

CROSS REFERENCE

The non-provisional application claims priority to Taiwan Patent Application No. 109114923, filed on May 5, 2020, the content thereof is incorporated by reference herein.

FIELD OF THE INVENTION

The present invention relates to the field of a projectile that can be fired by weapons, and more particularly to a projectile that has no casing or shell and can be fired by weapons.

BACKGROUND OF THE INVENTION

Today's common guns fire bullets. Conventional pistol bullets have a two part shell. The two parts of the shell can separate from each other when fired. There are many disadvantages in the traditional projectiles. For example, when the pistol is fired, the cartridge case needs to be ejected out of the barrel, and high heat generated by the combustion of the bullet in the gun may cause expansion and deformation of the cartridge case and cause jamming. Also, the direction of the force generated when the bullet and the casing are separated will also affect the accuracy.

In addition, the conventional gun barrel has a rifle (also known as Rifling), which is used to make the conventional bullet rotate along the longitudinal axis of the rifle when it is launched, resulting in a gyroscopic effect to stabilize the trajectory, and then more accurately shoot at the target. However, the groove of the rifling in the barrel may accumulates sand, which may cause the barrel to burst or explode.

In view of these disadvantages, there is an urgent need in the art for an improved projectile, which can overcome many of the defects of conventional shells and can achieve accurate firing without rifling.

SUMMARY OF THE INVENTION

The summary of the invention aims to provide a simplified summary of the disclosure, so that the reader has a basic understanding of the disclosure. This summary of the invention is not a complete overview of the disclosure, and it is not intended to point out important/critical elements of embodiments of the invention or define the scope of the invention.

On the basis of understanding the prior art, based on years of development experience, the inventor of the present invention provides a caseless projectile which fixes the bullet head and the body together as a projectile, preferably made in one piece; When the caseless projectile is fired in a barrel, the step of ejecting the shell and the problems caused by needing to remove the shell from the barrel can be avoided. Furthermore, the bottom of the caseless projectile has a plurality of scribe or score lines. When firing, the scoring structure is transformed into a plurality of nozzle structures by the impact force, so that the high-pressure gas generated by the combustion of the gunpowder is discharged from the nozzle structure, providing a rotation torque of the caseless projectile, which further eliminates the need for rifling to achieve the rifling effect and increases firing accuracy. The novel invention can be reasonably applied to the projectile for a variety of firearms (such as shotguns, submachine guns, artillery or anti-aircraft guns, etc.).

Accordingly, a first aspect of the present invention relates to a caseless projectile, which includes an elastic body including: an elastic body shell; a projectile head, the projectile head having a first interface and a second Interface; and an inner chamber for filling a certain volume of gunpowder, the inner chamber has a first end and an axially opposite second end.

The caseless projectile further includes a projectile bottom for closing the second end, which includes: an impact center area located in the central area of the projectile bottom, in one embodiment, the radius of the impact center area is about 0.1 of the radius of the projectile.

The central area of the impact center includes: a primer used for collision and ignition; an anvil to be hit by the firing pin of the barrel at the time of firing; and a flame mouth to allow the flame generated after the firing base detonates to pass through, and then ignite the gunpowder; the bottom of the projectile also contains a blade area, located in the area surrounding the impact center area, the blade area includes: a plurality of scribe lines; The impact force presents a plurality of nozzle structures, which are used to ignite the high-pressure gas produced by the ignition of the gunpowder from the nozzle structure. In the present embodiment, the thickness of the peripheral area is thicker than the thickness of the central impact area and the blade area, and in other embodiments, the thickness of the blade area is about 0.35 of the thickness of the peripheral area. Preferably, the thickness of the scribe line is about 0.025 of the thickness of the peripheral area.

In an embodiment of the caseless projectile, the first interface is covered by a part of the shell of the projectile.

In an embodiment of the caseless projectile, the second end is formed by the closed bottom of the projectile.

The caseless projectile according to an embodiment, the bullet head and a part of the shell is flat, round, tapered, or armor-piercing pointed and the gunpowder is liquid, solid powder, solid granular, gaseous or a combination of the above.

In an embodiment the scribe line includes: a radial scribe line extending from an end point on the circumference of the impact center area to the outer edge of the blade area of the other end point and an arc scribe line connected to the end point of the radial scribe line located at the outer edge of the blade area. Preferably, the length of the radial scribe line is about 0.6 of the radius of the projectile bottom and the arc length is about 0.8 of the radius of the projectile bottom.

According to a preferred embodiment of the present invention, the bottom has a coupling structure for combining with the elastic body; according to another preferred embodiment of the present invention, the peripheral region has a plurality of grooves to be used with one of the ejection elements in the barrel to eject the projectile that cannot be fired from the barrel.

After referring to the following embodiments, those with ordinary knowledge in the technical field to which the present invention pertains to can easily understand the basic spirit of the present invention and its purpose, as well as the technical means and implementation aspects adopted by the present invention.

BRIEF DESCRIPTION OF THE DRAWINGS

In order to make the above and other objects, features, advantages and embodiments of the present invention more obvious and understandable, the drawings are described as follows.

Figure 1:
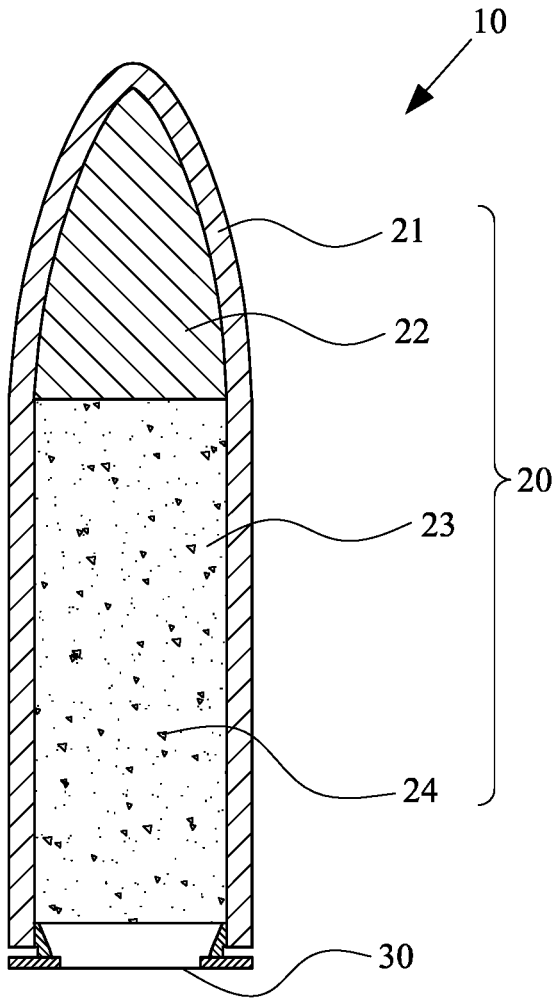
FIG. 1 is a cross-sectional view of a caseless projectile according to an embodiment of the present invention.

According to the usual working methods, the various features and components in the figures are not drawn according to the actual scale. The drawings present the specific features and components related to the present invention in the best way. In addition, between different drawings, the same or similar element symbols refer to similar elements and components.

DETAILED DESCRIPTION OF THE PREFERRED EMBODIMENTS

In this section, the contents of the present invention will be described in detail through the following examples. These examples are for illustration only, and those skilled in the art can easily think of various modifications and changes. Various embodiments of the present invention will be described in detail below. In this specification and the appended patent applications, unless the context clearly indicates otherwise, "a" and "the" can also be interpreted as plural. In addition, in this specification and the scope of the attached patent application, unless otherwise stated in the context, "middle" and "inner" include "located in"; and unless otherwise stated in the context, the direction of the tip of the projectile was defined as "upper" or "lower". Furthermore, titles and subtitles may be attached to the description for easy reading, but these titles do not affect the scope of the present invention.

The terms used in this specification are generally within the scope of the present invention and the specific context of each term has its usual meaning in related fields. The specific terms used to describe the present invention in this specification will be described below or elsewhere in this specification, so as to help people in the industry understand the relevant description of the present invention. The same term has the same scope and meaning in the same context. In addition, there is more than one way to express the same thing; therefore, the terms discussed in this article may be replaced by alternative terms and synonyms, and whether a term is specified or discussed in this article does not have any special meaning. This article provides synonyms for certain terms, but the use of one or more synonyms does not mean that other synonyms are excluded. The examples provided in this specification are for illustrative purposes only, and are not intended to limit the scope and meaning of the invention or any exemplified terms. Likewise, the invention is not limited to the various embodiments listed in this specification.

Although the numerical ranges and parameters used to define the present invention are approximate values, the relevant values in the specific embodiments have been presented as accurately as possible. However, any numerical value inevitably contains standard deviations due to individual test methods. Here, "about" generally means that the actual value is within plus or minus 10%, 5%, 1%, or 0.5% of a specific value or range. Or, the term "about" means that the actual value falls within the acceptable standard error of the average value, which is determined by those with ordinary knowledge in the field to which the present invention belongs. Therefore, unless otherwise stated to the contrary, the numerical parameters disclosed in this specification and the accompanying patent application are approximate values and can be changed as required. At least these numerical parameters should be understood as the indicated significant digits and the values obtained by applying the general rounding method.

In order to solve the problems existing in the prior art, the present invention provides a novel caseless projectile, which fixes the warhead and the body into an elastic body, which is preferably made in one piece. When the projectile is fired in a barrel, the step of ejecting the cartridge case is avoided. Furthermore, the bottom of the projectile has a plurality of scribe lines. When fired, through the impact force, the scribe line is transformed into a plurality of nozzle structures, so that the high-pressure gas generated by the burning of gunpowder is ejected from the nozzle structure, providing a rotating movement of the caseless projectile, which further achieves the effect of accurate firing without rifling.

EXAMPLES

Figure 2:
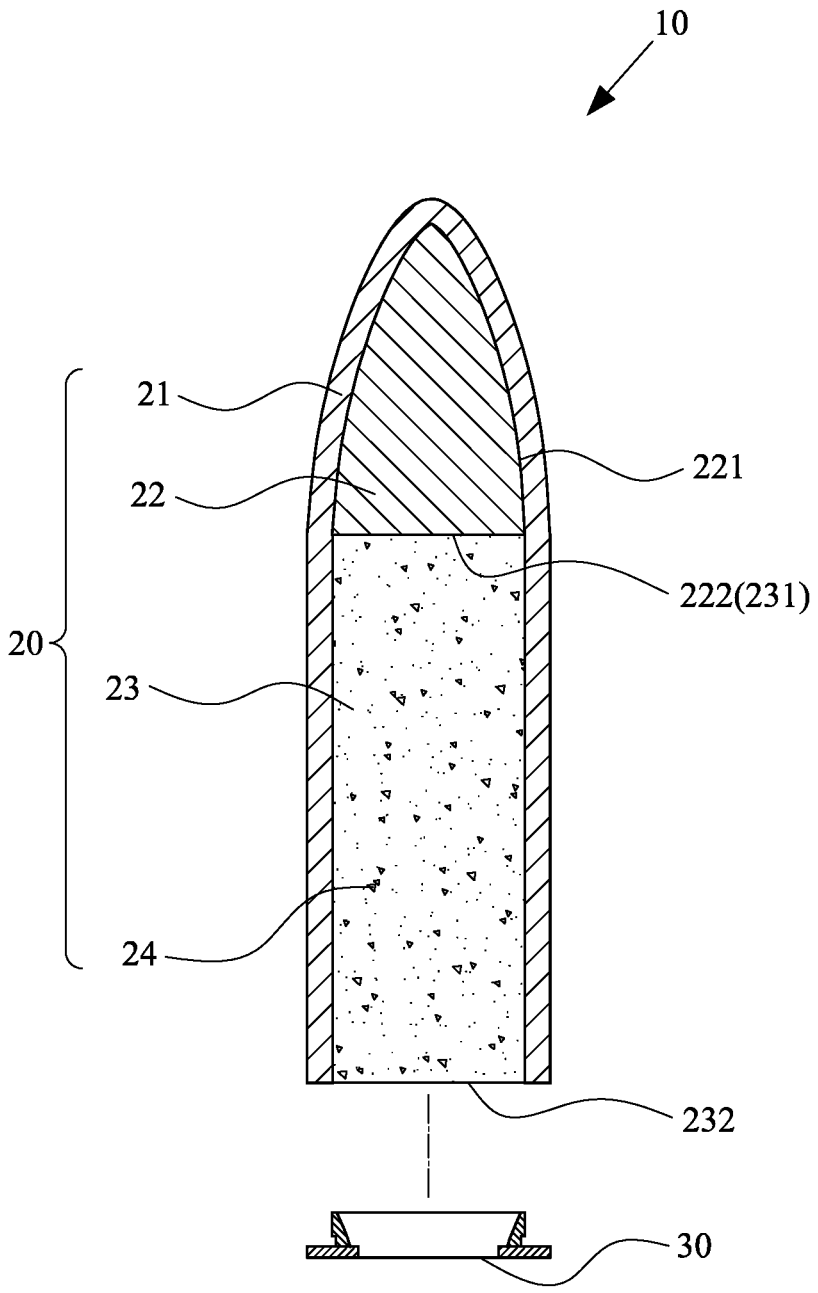
FIG. 2 is an exploded cross-sectional view of a caseless projectile according to an embodiment of the present invention.

FIG. 1 is a cross-sectional view of a caseless projectile according to an embodiment of the present invention, and FIG. 2 is an exploded cross-sectional view of a caseless projectile according to an embodiment of the present invention. Please refer to FIG. 1 and FIG. 2 together. The caseless projectile 10 of the present invention mainly includes an elastic body 20 and an elastic bottom 30; it should be noted that according to FIG. 2, the projectile bottom 30 is exploded, which is presented for convenience but is a non-limiting embodiment, regardless of whether it is in the firing state.

Please continue to refer to FIG. 1 and FIG. 2, the projectile 20 includes a projectile shell 21 and a projectile head 22; the projectile head includes a first interface 221 and a second interface 222; in some embodiments, the projectile head 22 is covered by a part of the projectile shell 21, and according to the content shown in the figure, it can be understood that the projectile head 22 and a portion of the projectile shell 21 that wraps it are round. However, those with ordinary knowledge in the technical field to which the present invention belongs can change the shape according to their needs, for example, the shape can be flat, round, tapered or armor-piercing pointed. In addition, the projectile shell 21 is made of copper or its alloy in a preferred embodiment, and the projectile head 22 is made of lead in a preferred embodiment.

Please continue to refer to FIG. 1 and FIG. 2, the projectile 20 includes an inner chamber 23 for filling with a certain volume of gunpowder 24, the inner chamber 23 has a first end 231 and axially opposite to the second end 232. It should be understood that the volume of the gunpowder 24 can be changed according to the needs of those with ordinary knowledge in the technical field to which the present invention belongs, and the gunpowder 24 can be liquid, solid powder, solid granular, gaseous state, or a combination of the above. The first end 231 is closed by the second interface, and the second end 232 is closed by the projectile bottom 30.

Figure 3A:
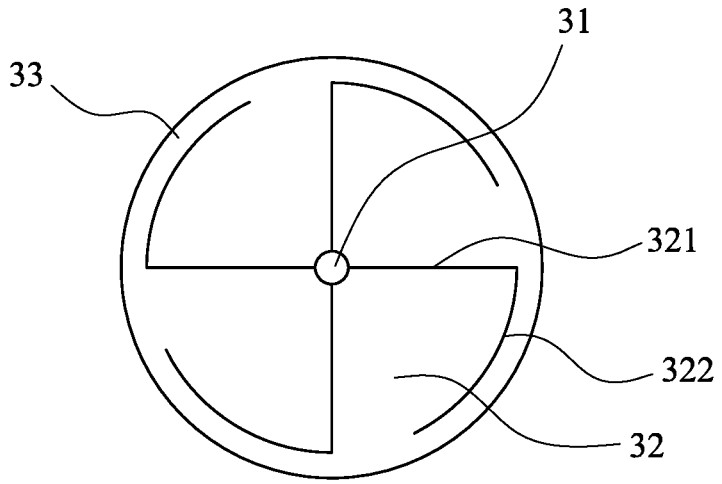
FIGS. 3A and 3B are bottom views of a caseless projectile according to an embodiment of the present invention.
Figure 3B:
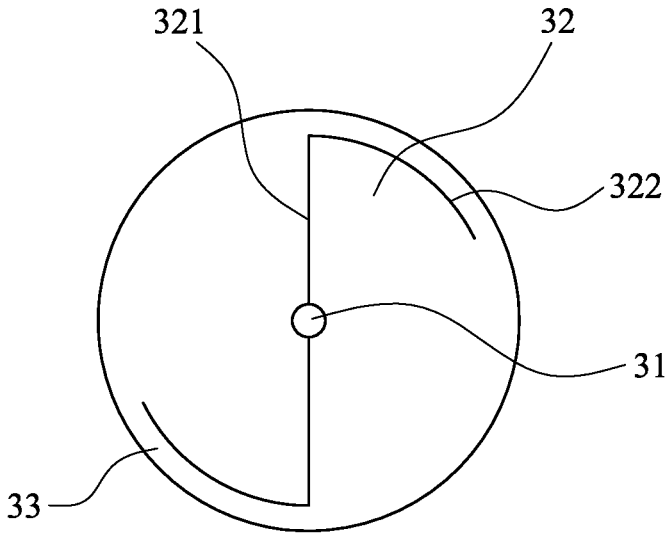
Figure 4:
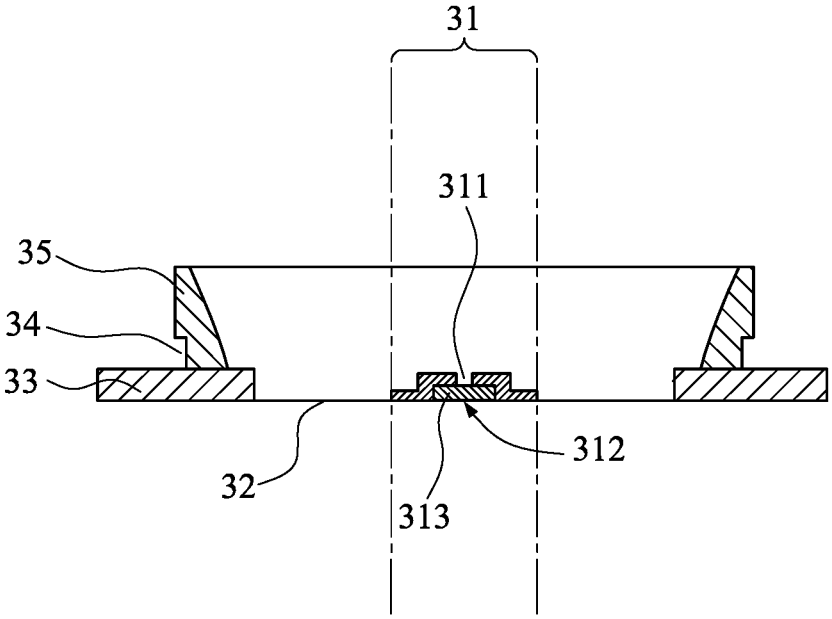
FIG. 4 is a bottom cross-sectional view of a caseless projectile according to an embodiment of the present invention.

FIG. 3A and FIG. 3B are bottom views of a caseless projectile according to different embodiments of the present invention, and FIG. 4 is a bottom cross-sectional caseless projectile according to an embodiment of the present invention. Please refer to FIGS. 3A, 3B and 4 together. Extending from the center of the projectile bottom 30 to the circumferential direction, the projectile bottom 30 can be divided into an impact center area 31, a blade area 32 and a peripheral area 33, respectively.

In an embodiment, the impact center region 31 has a radius of about 0.1 of the radius of the bottom of the projectile 30.

According to the drawing shown in FIG. 4, it can be understood that the impact center area 31 includes a flame port 311, an anvil 312, and a primer 313. When the projectile is fired, an impact element in the barrel (for example: a striker) strikes the anvil 312, and the primer 313 is ignited and detonated, the flame caused by the detonation passes through the flame port 311, and then ignites the gunpowder 24; more specifically, the primer 313 is disposed above the anvil 312 in terms of structure, and the flame mouth 311 is disposed above the primer 313.

In an embodiment, the fan blade region 32 includes a plurality of scribe lines; in an embodiment, the scribe lines include a radial scribe line 321 and an arc scribe line 322, respectively. The radial scribe line 321 extends from an end point on the circumference of the impact center area 31 to another end point on the outer edge of the blade area 32 (that is, the inner edge of the peripheral area 33); and the arc line 322 and the radial scribe line 321 is located at the end of the outer edge of the fan blade area. According to the content shown in FIG. 3A, it can be understood that the fan blade area 32 has four engraved lines; and in another embodiment, as shown in FIG. 3B it can be understood that the fan blade area 32 has two score lines. Those with ordinary knowledge in the technical field to which the case belongs can change the number of the score lines according to requirements.

In addition, the peripheral area 33 is the area between the outer edge of the fan blade area 32 and the circumference of the projectile bottom 30. The thickness of the peripheral area 33 is greater than the thickness of the central impact zone 31 and the fan blade area 32. The thickness of the blade area 32 is about 0.35 of the thickness of the peripheral area 33. The thickness of the scribe line is about 0.025 times the thickness of the peripheral area 33. The length of the scribe line 321 is about 0.6 times the radius of the projectile bottom 30. The length of the arc line 322 is about 0.8 times the radius of the projectile bottom 30.

As can be understood from FIG. 4, in a non-limiting embodiment, the projectile bottom 30 has a row of bullet grooves 34 for matching with a row of bullet elements in the barrel (for example: bullet ejector hook) for ejecting the projectile that cannot be fired from the barrel. The projectile bottom 30 has a binding structure 35 that can be used to combine with the projectile 20, using strong adhesives or other materials. Those with ordinary knowledge in the technical field to which the invention belongs can combine in various ways.

Figure 5:
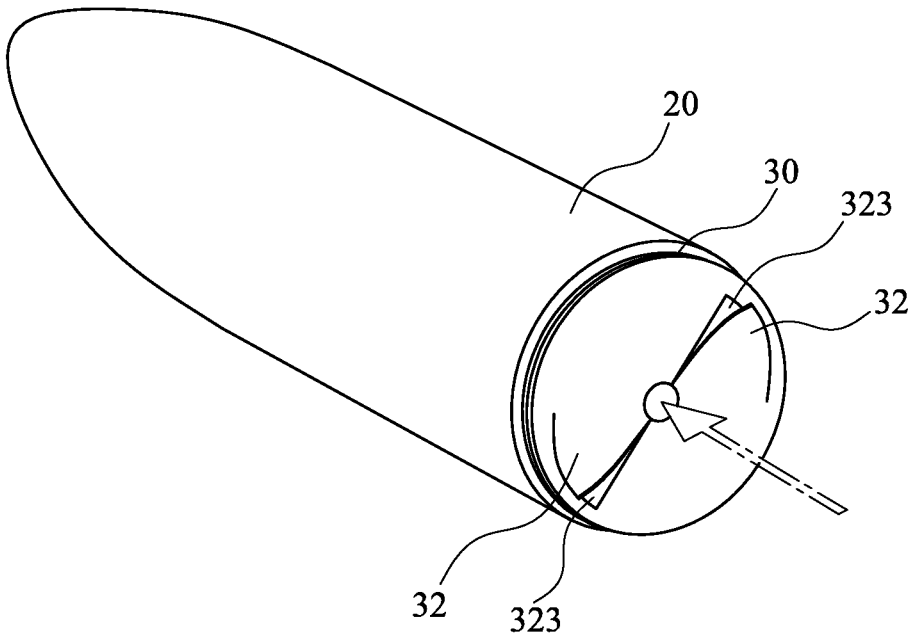
FIG. 5 is a three-dimensional action diagram of a caseless projectile when fired according to an embodiment of the present invention.
Figure 6:
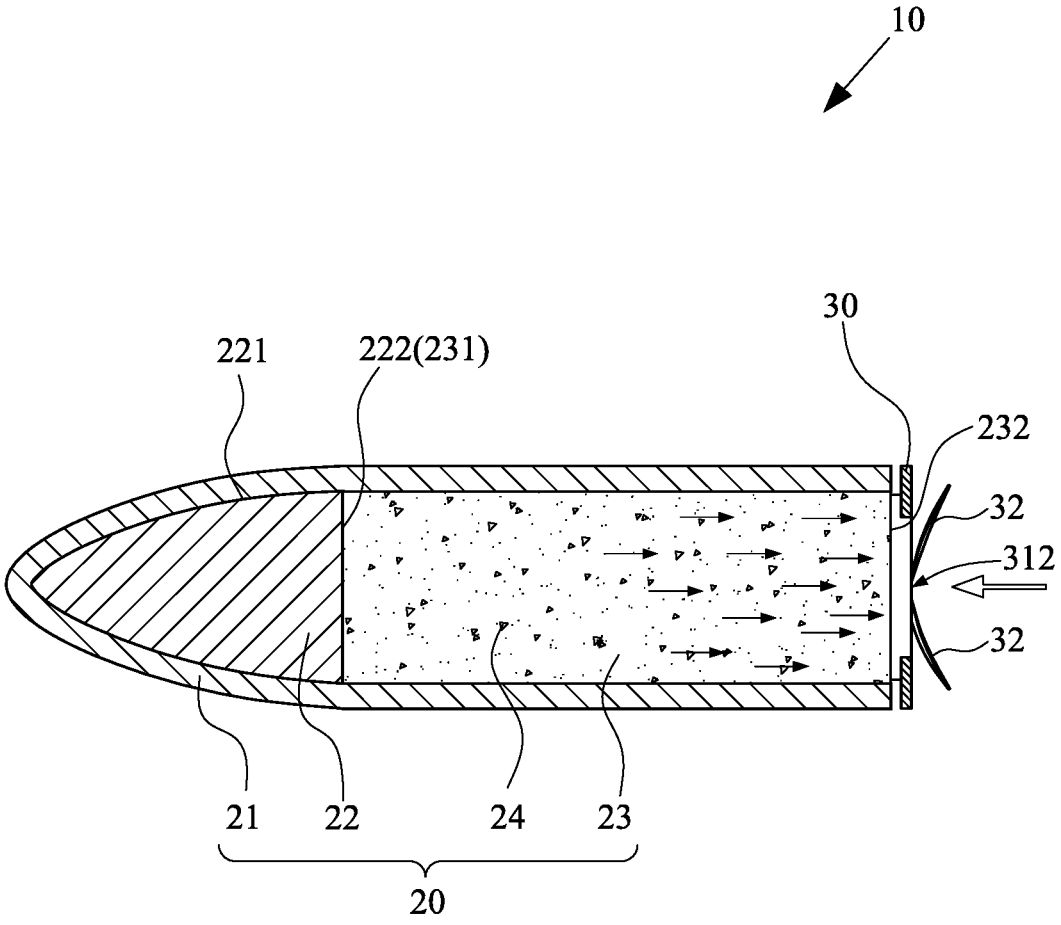
FIG. 6 is a side view of a caseless projectile when fired according to an embodiment of the present invention.

FIG. 5 is a three-dimensional action diagram of a caseless projectile during firing according to an embodiment of the present invention, and FIG. 6 is a side view action diagram of the caseless projectile at the time of firing according to an embodiment of the present invention. Please refer to FIGS. 5 and 6 together. During the firing process, when the impact element (for example: firing pin) of the barrel strikes the anvil 312, the plurality of scribe lines are simultaneously broken due to the difference in thickness from other regions, and due to the shape of the scribe lines, the broken lines appear as a plurality of nozzle structures 323, which can cause the high pressure gas generated by the ignition of the gunpowder 24 is ejected from the nozzle structure 323, thereby providing a rotation torque of the caseless projectile 10 to stabilize the firing of the caseless projectile 10.

In summary, the specific embodiments of the present invention have been disclosed, but it is not intended to limit the present invention. Those with ordinary knowledge in the technical field to which the present invention belongs are capable of understanding. And in the case of deviating from the principle and spirit of the present invention, various changes and modifications can be made to it, so the scope of protection of the present invention should be based on those defined in the scope of the accompanying patent application.

What is claimed is:

1. A caseless projectile, including: an elastic body, including: an elastic body shell; an elastic head, the elastic head having a first interface and a second interface; and an inner chamber for filling with a certain volume of gunpowder, the inner chamber having a first end and an axially opposite second end; a projectile bottom for closing the second end, which includes: an impact center area, a fan blade area and a peripheral area; the impact center area is located in the central area of the projectile bottom, which includes: a primer for impact ignition; an anvil for impact by a firing pin of a barrel during firing; and a flame port for allowing flame generated after the primer is detonated to pass through and ignite gunpowder; and the fan blade area located in an area surrounding the impact center area, the fan blade area containing a plurality of scribe lines, wherein the scribe lines in the firing process are in the middle and a plurality of nozzle structures are present due to impact force, so that high-pressure gas produced by ignition of the gunpowder is ejected from the nozzle structures; and the peripheral area located between an outer edge of the fan blade area and a circumference of the projectile bottom; wherein thickness of the peripheral area is thicker than thickness of the central impact area and the fan blade area.

2. The caseless projectile of claim 1, wherein the first interface is covered by a part of the elastic body shell.

3. The caseless projectile of claim 1, wherein the first end is closed by the second interface.

4. The caseless projectile of claim 1, wherein the scribe line includes: a radial scribe line extending from an end point on the circumference of the impact center area beyond the fan area to another end point on the rim; and an arc scribe line connected to the end point of the radial scribe line located at the outer edge of the blade area.

5. The caseless projectile of claim 1, wherein the elastic head is flat, round, tapered or armor-piercing pointed.

6. The caseless projectile of claim 1, wherein the gunpowder is liquid, solid powder, solid granular, gaseous, or a combination thereof.

7. The caseless projectile of claim 1, wherein a radius of the impact center area is about 0.1 of radius of the projectile bottom.

8. The caseless projectile of claim 1, wherein a thickness of the fan blade area is about 0.35 of thickness of the peripheral area.

9. The caseless projectile of claim 4, wherein a length of the radial scribe line is about 0.6 of radius of the projectile bottom.

10. The caseless projectile of claim 4, wherein an arc length of the arc line is about 0.8 of the radius of the projectile bottom.

11. The caseless projectile of claim 1, wherein a thickness of the scribe line is about 0.025.

12. The caseless projectile of claim 4, wherein a thickness of the scribe line is about 0.025.

13. The caseless projectile of claim 1, wherein the projectile bottom has a plurality of bullet grooves which are used with a plurality of barrel elements in the barrel to eject unfired projectiles from the barrel.

14. The caseless projectile of claim 1, wherein the elastic body shell has a coupling structure for combining with the elastic head.

15. The caseless projectile of claim 1, wherein the elastic body shell is made of copper or its alloy.

16. The caseless projectile of claim 1, wherein the elastic head is made of lead.

* * * * *